US006789915B2

(12) United States Patent
Van Der Poel et al.

(10) Patent No.: US 6,789,915 B2
(45) Date of Patent: Sep. 14, 2004

(54) ROAD-MARKING SYSTEM

(75) Inventors: Lucas Leo Desiree Van Der Poel, Eindhoven (NL); Gerrit Gijsbertus Van Bochove, Ochten (NL); Leonardus Urbanus Emile Konings, Eindhoven (NL); Antonius Henricus Maria Raaijmakers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 387 days.

(21) Appl. No.: 09/866,821

(22) Filed: May 29, 2001

(65) Prior Publication Data

US 2002/0012244 A1 Jan. 31, 2002

(30) Foreign Application Priority Data

May 30, 2000 (EP) ..... 00201916
Sep. 14, 2000 (EP) ..... 00203198

(51) Int. Cl.[7] ..... E01F 9/00
(52) U.S. Cl. ..... 362/153.1; 404/9; 404/12

(58) Field of Search ..... 362/153.1; 404/9, 404/12

(56) References Cited

U.S. PATENT DOCUMENTS 5,839,816 A * 11/1998 Varga et al. ..... 362/153.1
6,354,714 B1 * 3/2002 Rhodes ..... 362/145

FOREIGN PATENT DOCUMENTS

WO 97/03250 1/1997
WO 00/20691 4/2000

* cited by examiner

*Primary Examiner*—Thomas M. Sember
*Assistant Examiner*—Jacob Y. Choi
(74) *Attorney, Agent, or Firm*—Ernestine C. Bartlett

(57) ABSTRACT

A road-marking system comprising at least a first (1) and a second road-marking unit (2) each having an emission surface (10; 20), the first unit comprising a first light source (21, 21' . . . ) and the second unit comprising a second light source (22, 22' . . . ). Each unit has a shape adapted to a saw-cut recess (9) accommodating the unit.

12 Claims, 4 Drawing Sheets

ROAD-MARKING SYSTEM

The invention relates to a road-marking system comprising:

at least a first and a second road-marking unit each having an emission surface, the first unit comprising a first light source and the second unit comprising a second light source.

Such a road-marking system is known from WO-00/20691 (PHN 17533). The road-marking system is used in traffic-control systems for marking traffic routes for vehicles, such as roads for cars and other road users, and runways for aircraft. One of the methods used by traffic planners in their attempts to reduce traffic jams is a so-called "tidal flow system". In such a dynamic system, the direction of the traffic of multi-lane roads is changed in one or more lanes in accordance with the direction of the main flow of traffic. In an alternative embodiment, the number of lanes available to traffic moving in a specific direction is increased or reduced in dependence on the amount of traffic. A problem with these methods lies in the indication of the direction of the desired flow of traffic for a specific lane in a flexible manner, or in the actual changing of the arrangement of the traffic route in a flexible manner. Known means for indicating the desirable direction of the flow of traffic include signaling lights beside or above the traffic route.

Said road-marking systems cannot only be used as dynamic road-marking systems; they can also be given static applications. Static applications of road-marking systems include marking parts of traffic routes (for example straight parts or bends) so as to give guidance to the direction of the traffic under certain weather conditions, for example during fog, rain, black ice, etc., and/or under certain light conditions, such as daylight, twilight, a low position of the sun, night, etc.

Road-marking systems may be provided beside and/or above the traffic route, for example on a crash barrier alongside the traffic route. Road-marking systems may also be provided in a road surface of the traffic route by making recesses therein, in which recesses the known systems are to be inserted and retained. The known road-marking systems have the disadvantage that the method of making said recesses is cumbersome and difficult and leads to relatively large decrease in the mechanical strength of the road at the locations of the recesses.

It is an object of the invention to provide a road marking system of the type described in the opening paragraph in which this disadvantage is counteracted.

According to the invention, this object is achieved in that each unit has a shape adapted to a saw-cut recess for accommodating the unit. Such a recess made in a (solid) body, for example a road, in which the unit is to be accommodated, is simple and easily obtainable by a movement perpendicular to a surface of said body by a saw. The movement may also be skew with respect to said surface, resulting in a skew recess in which the unit is positioned at an acute angle to said surface. Such a position of the unit enables a reduction of the risk of impact damage and tilting of the unit with respect to said surface due to forces exerted by vehicles. Preferably, the recess for accommodating the unit has a cylindrical bottom part in the shape of a circular segment, in which case the saw, for example, is a circular saw. The recess thus obtained in the body, for example in a road made of asphalt or concrete or ZOAB, i.e. "Zeer Open Asfalt Beton" in English "open-pore bituminous concrete", has smooth walls which a relatively great mechanical strength. Contrary to the method of making the recess used for the known unit with the aid of a milling cutter, an extra number of voids in these walls is avoided because particles are cut in the method of making the recess for the unit of the system according to the invention instead of being thrown out. Since the unit and the recess are adapted to each other, the unit has a narrow fit in the recess. A unit accommodated in the recess thus bears for a substantial portion on the walls of the recess and is kept positioned thereby. The adapted shape of the unit achieves that the emission surface of the unit projects only to a small extent, for example by 3–4 mm, above a road surface of the road provided with the recess.

In the description of the current invention, a "light source" is defined as a subunit which emits (visible) light, the origin of said light not necessarily being situated at the location of the light source. For example, light emitted by the light source may also be generated at a distant location and be transmitted, for example, by means of light waveguides, such as optical fibers, from a so-called light generator to the "light source". The term "light source" generally does not refer to light generated by reflection of light, in particular light emitted by a vehicle which is reflected at the location of the "light source". Furthermore, in this description, light beams which show a "uniform overlap" are to be taken to mean light beams which cannot be distinguished by the human eye under the above-mentioned conditions.

Light issues from the first and the second light source at an angle $\alpha$ of 0.1–25° with the road surface. The light has a beam width angle of about 45° enabling it to be seen by a viewer at an angle $\alpha$ of at least 45° with the road surface. It is achieved by the measure in accordance with the invention that a road user, for example a motorist or a truck driver who, from his vehicle, looks ahead at the traffic on the road and the markings in the road surface, observes from a distance equal to or above 40 m that the light beams originating from the first light source in the first road-marking unit and from the second light source in the second road-marking unit show a uniform overlap. Light originating from the first and the second light source at an angle $\alpha$ of 0.1–8° with the road surface is perceived as an imaginary "white" line under said conditions. The light has a beam angle of about 45° enabling it to be seen by a viewer under an angle of 45° with the road surface. This is the case particularly if the light originates from a plurality of such light sources, for example a suitably chosen (two-dimensional) arrangement of light sources. A particularly suitable arrangement of light sources is a one-dimensional array of four light sources per unit. Said four light sources, which extend transversely to the direction of view of the road user, are so closely spaced that the human eye cannot distinguish these four light sources at a distance equal to or greater than 40 m. Said units situated in the extension of the observation field of the road user are provided, in accordance with the inventive measure, in such a manner that, given the viewing angle of the observer, light beams originating from the light sources of said units show a uniform overlap at a distance equal to or above 40 m. An observer situated at a distance greater than or equal to 40 m from the entire arrangement of a number of units with four light beams originating from each of said light sources, the angle of view of the observer ranging between 0.1 and 8°, will perceive said used said arrangement of light beams as an imaginary line in the road surface. The present invention may be used particularly effectively if the distance a between the road user and the first light source is in a range of: $40\ m \leqq a \leqq 100\ m$.

Preferably, a distance d between the first and the second unit lies in a range of between 10 and 25 cm. In this manner, a good display of the imaginary line is obtained by means of a limited number of units. If the distance d is smaller than 10 cm, a large number of units are necessary to achieve the desired effect. For distances above 25 cm, the coherence of the units is such that they are no longer perceived as forming a coherent object (imaginary line) by the road user. Particularly suitable is a distance d in the range between 15 and 20 cm.

The road-marking system of the invention is built up from independent units, which may, however, be electrically connected. The independent units do not form a large integral one-part array of units embedded in the road surface. Therefore requirements with respect to skid resistance imposed on these units are relatively low, because a good contact between wheels of vehicles and the road surface is determined mainly by the road surface itself and only to a small degree by these units. The road-marking system of the invention has another advantage in being safer to road users when it is out of operation, because it does not form a continuous line/stripe in the road surface which, under certain circumstances, might be confused with permanent "non-dynamic" road markings. The relatively narrow and shallow continuous stripe of the saw-cut, which is made for the electrical/optical cables interconnecting the units, does not lead to such confusion.

In an alternative embodiment of the road-marking system in accordance with the invention, the unit comprises a housing which accommodates a light source as well as an optical system for directing the radiation to be generated by the light source. Said light source comprises a plurality of optoelectronic elements, and said light generator is provided with control electronics for operating the optoelectronic elements. A recess in the road surface obtainable by the saw-cut or by a saw-cut combined with a drill-hole formes an attractive embodiment for accommodating the unit, the optical system and the light generating parts. The optical system may comprise a collimator lens with, optionally, a number of sublenses, the optical axis of each of the sublenses coinciding with the optical axis of one of the optoelectronic elements, and the optical system may also comprise a focusing lens. The focusing lens is preferably embodied so as to be a (positive) Fresnel lens. The advantage of using a light generator based on optoelectronic elements is that the housing of the light generator is completely closed. As a result of the long service life of the opto-electronic elements, the light source does not have to be replaced during the service life of the light generator. This favorable property enables the light generator to form part of the base module, so that the length of the necessary light guides can be substantially reduced. A further advantage of a light generator on the basis of optoelectronic elements is that such a light generator has a high resistance to shocks. Furthermore, the control electronics enables the light to be dimmed or change color in a simple manner, for example, by switching on or off specific optoelectronic elements. In addition, a light generator on the basis of optoelectronic elements has a high luminous efficacy.

In an embodiment, the road-marking system is characterized in that each unit comprises at least one stabilizer at least adjacent to the emission surface. The stabilizer reduces the risk of tilting of the unit with respect to the road surface due to forces exerted on the unit by the wheels of vehicles. Tilting of the units increases the risk of glare and/or distortion of the imaginary line. Preferably, the stabilizer has at least one duct at least substantially parallel to the line for passing electrical/optical cables. Separate recesses in the road surface for accommodating these stabilizers are not necessary, as these stabilizers can be accommodated in the recesses already present for the electrical/optical cables.

An optoelectronic element may be used as the light source. Preferably, the luminous flux of the optoelectronic element amounts to at least 5 lm during operation. Optoelectronic elements, also referred to as electro-optical elements, such as electroluminescent elements, for example light-emitting diodes, are very suitable for use as the light source. The optoelectronic element is preferably mounted in the road-marking unit. A relatively high luminous flux is necessary to generate enough light also at ambient light, for example sunlight or light originating from headlights, so that the light beam can be observed from a distance with sufficient brightness.

In a favorable embodiment the road marking system is characterized in that the opto-electronic element comprise LEDs, i.e. light-emitting diodes whose luminous flux is at least 5 lm during operation. The LED is combined with a collimator for collimating light from the LED and for directing the light through an opening in the emission surface. LEDs do not emit ultraviolet radiation, hence the unit and collimator can be made of synthetic materials, for example plastic, without an increased risk of degradation caused by the emitted light. Plastics involve relatively low system costs and increased system design possibilities. LEDs have a relatively long operational life, for example 50,000 hours or more, offering the road marking system the advantage that maintenance costs may be significantly reduced. Another advantage is that LEDs are electronically dimmable light sources, electronic dimming being more efficient than mechanical dimming. Each single LED is optically coupled to a respective single collimator, for example a Compound Parabolic Concentrator (CPC). Thanks to the collimator, the LEDs are no longer positioned in the emission window, thus reducing the risk of failure of the LEDs. The light from the relatively large LED, with a light emission window of about 5 mm, is collimated by the collimator, for example in that the collimator has a prismatic shape, and is emitted through a relatively small opening, for example 1–2 mm, in the emission surface. It is an advantage of the road marking system with the collimator that the emission surface of the unit need project to a small extent only, for example by 1.5–2 mm, above the road surface of the road provided with the recess, to emit the light fully. Furthermore, the collimator has the advantage that its shape is easily adjusted so as to form a desired beam of the light emitted from the emission surface.

A very suitable alternative light source for use in the road-marking system is formed by an end portion of an optical fiber. This has the advantage that the light emitted by the light source is generated in a light generator at a distance from the road-marking unit and transmitted from the light generator to the light source by means of optical fibers. The light generator may comprise a light source accommodated in the housing, for example a semiconductor light source such as an optoelectronic element, or a discharge lamp, such as a mercury discharge lamp. If the discharge lamp has a discharge path with a length of at most 2 mm, its light can be generated at the emission surface, thereby circumventing the necessity of transporting of light originating from the light source through an optical fiber. In an attractive modification of this embodiment, the light generator comprises a first end of at least one light guide, which light guide is optically coupled at a second, opposite end to the light source in the road-marking unit. The light source in the light generator is preferably arranged at a distance from the road-marking unit so that said light source can be readily replaced, for example at the end of its service life. A further advantage of employing optical waveguides is that the use of optical fibers results in a very efficient use of light, which entails no, or at least very little, light pollution.

Light pollution is to be taken to mean the loss of light caused by the fact that areas are illuminated where illumination is unecessary and/or undesirable. An advantage of the use of optical waveguides over the use of optoelectronic elements is that no electric voltages and currents have to be fed to the light source via the road surface in the case of optical fibers. This results in an increased traffic safety. The risk of an electric voltage flashover or a short-circuit, which might cause an undesirable explosion, is precluded also in the case of accidents and other calamities.

The invention further relates to a road-marking complex which is provided with one or more road-marking systems in accordance with the invention, with a control system for the road-marking systems, and with means for coupling the road-marking systems to the control system. The means for coupling the one or several road-marking systems to the control system may be embodied so as to be a cable for guiding electrical or optical signals. In a modification, the means for coupling are embodied so as to be a wireless connection by means of an emitter/receiver pair, wherein the emitter sends control signals from the control system to a receiver incorporated in the road-marking complex.

An embodiment of the road marking system of the invention is shown diagrammatically in the drawing, in which FIG. 1 is a cross-sectional view of a unit of a road marking system according to the invention;

Figure 1:
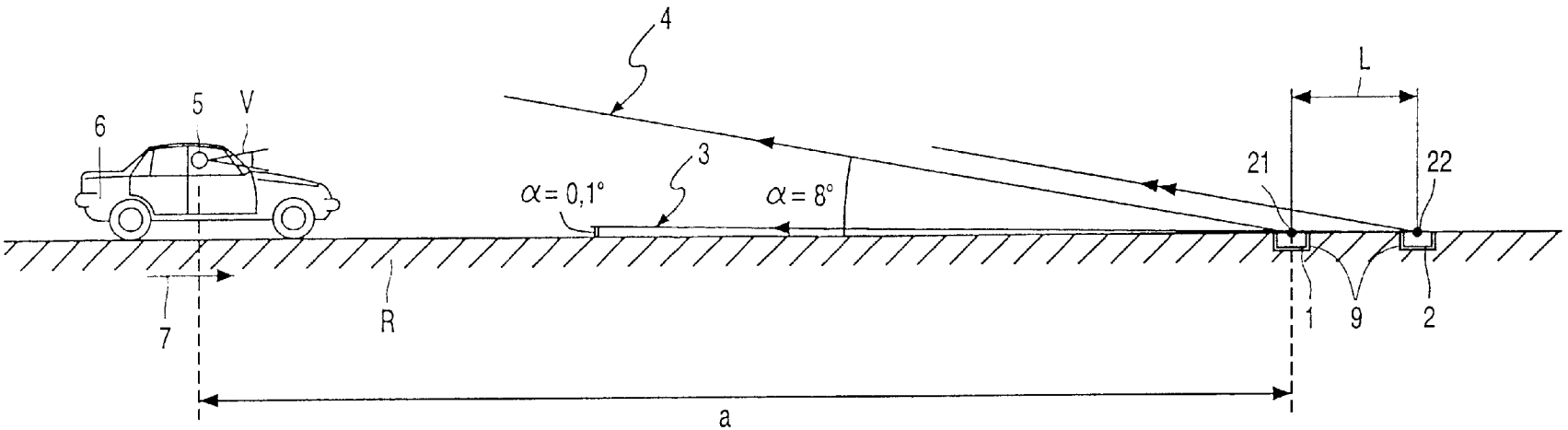
Figure 2:
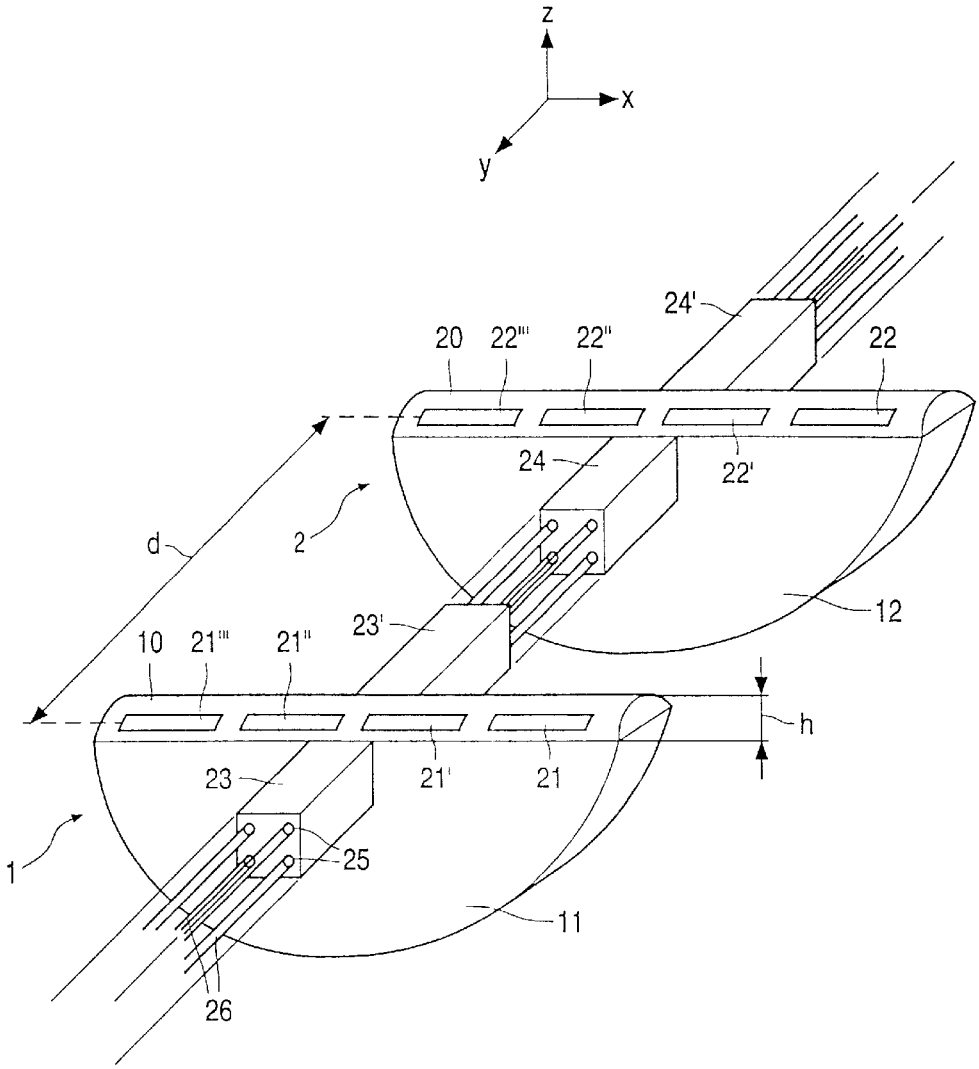
FIG. 2 is a perspective view of the road marking system with units of FIG. 1. accommodated in a road surface.

FIG. 1 is a cross-sectional view of a road-marking complex in accordance with the invention. Said road-marking complex comprises a first road-marking unit 1 and a second road-marking unit 2, which are both accommodated in and have a shape adapted to a respective recess 9, made by a circular saw in a road with a road surface R. In the first embodiment of the road-marking complex in accordance with the invention as shown in FIG. 2, each of the road-marking units 1; 2 is composed of a housing 11; 12, which housings are each provided with at least one light source at a respective emission surface 10; 20, of the housing, in this example four first light sources 21, 21', in the first housing 11, and four second light sources 22, 22', in the second housing 12, the light sources in the Figure being LEDs. To protect the light sources from damage, the first light sources 21, 21', . . . are recessed in the first housing 11, and the second light sources 22, 22, . . . are recessed in the second housing 12 (see FIG. 2).

In FIG. 2, a system of coordinates is shown for orientation purposes. A plane which incloses an angle $\alpha$ with the first light source 21 is represented in the cross-sectional view of FIG. 1 by means of a line 3; 4, where $\alpha$=0.1° for the line referenced 3, and $\alpha$=8° for the line referenced 4. An observer 5 having a field of view V and sitting in a vehicle 6 moving in a direction 7 is situated at distance a from the first light source 1 in the situation shown in FIG. 1, where the distance a≧40 m. In accordance with the invention, light beams emitted by the first and the second light source 21, 22 cannot be distinguished by the human eye having a field of view V. In other words, light beams emitted by the first and the second light source 21, 22 show a uniform overlap in the plane which incloses an angle ($\alpha$) of 0.1 to 8° with a line L connecting the first light source 21 to the second light source 22, the distance a being >=40 m. In other words, light emitted by the first and the second light source 21, 22 is perceived as an imaginary line under the above-mentioned conditions. Preferably, the distance a between the observer 5 and the first light source 21 lies in the range of 40≦a≦100 m.

By way of example, the eye of a driver of a passenger car 6 is situated approximately one meter above the road surface, or the eye of a truck driver is situated approximately 3 meters above the road surface. At a distance of, for example, 50 m from their vehicles, the driver of the car will look at the surface of the road R at a viewing angle of arc tan(1/50)=1.2°, and the truck driver will look at the surface of the road at a viewing angle of arc tan(3/50)=3.4°. These observers will see that the light beams originating from the first and the second light source 21; 21' seem to have a uniform overlap from said distance. In a particularly suitable embodiment of the road-marking complex in accordance with the invention, 1≦$\alpha$≦4°.

FIG. 2 further shows the specific shape of the housing 11; 12 of the unit 1; 2 adapted to a recess obtained by a saw-cut with a circular saw, i.e. a segment of a circle. Also shown are the mutual positions of the units 1; 2 at a distance d, in the Figure. 18 cm, when provided in the road. Each unit is provided with two respective stabilizers 23, 23'; 24, 24' oppositely positioned at their respective emission surfaces 10; 20. The stabilizers have ducts 25 enabling electrical/optical cables 26 to pass through the units, the units being electrically/optically interconnected by these cables. The emission surface 10; 20 projects from the road surface R over a height h, h being in the range from 2 to 5 mm.

Figure 3:
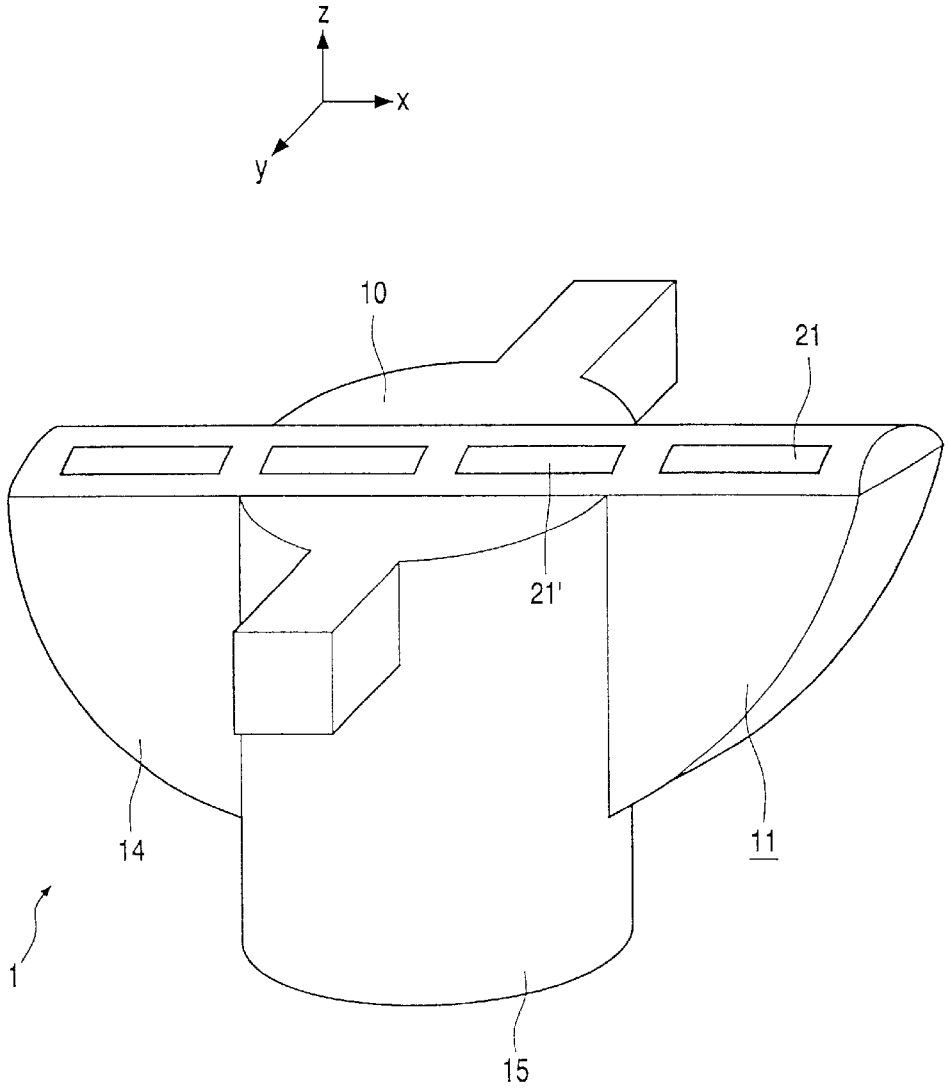
FIG. 3 is a perspective view of an alternative embodiment of a road-marking unit according to the invention.

FIG. 3 shows an embodiment of the unit 1 having a housing 11 with a shape which is a combination of a cylindrical circular segment 14 and a circular cylinder 15 perpendicular to the emission surface 10. The circular cylinder 15 accommodates an optical system for directing the radiation to be generated by the light source and light generating parts, i.e. a light generator being provided with control electronics for operating the light source.

Figure 4:
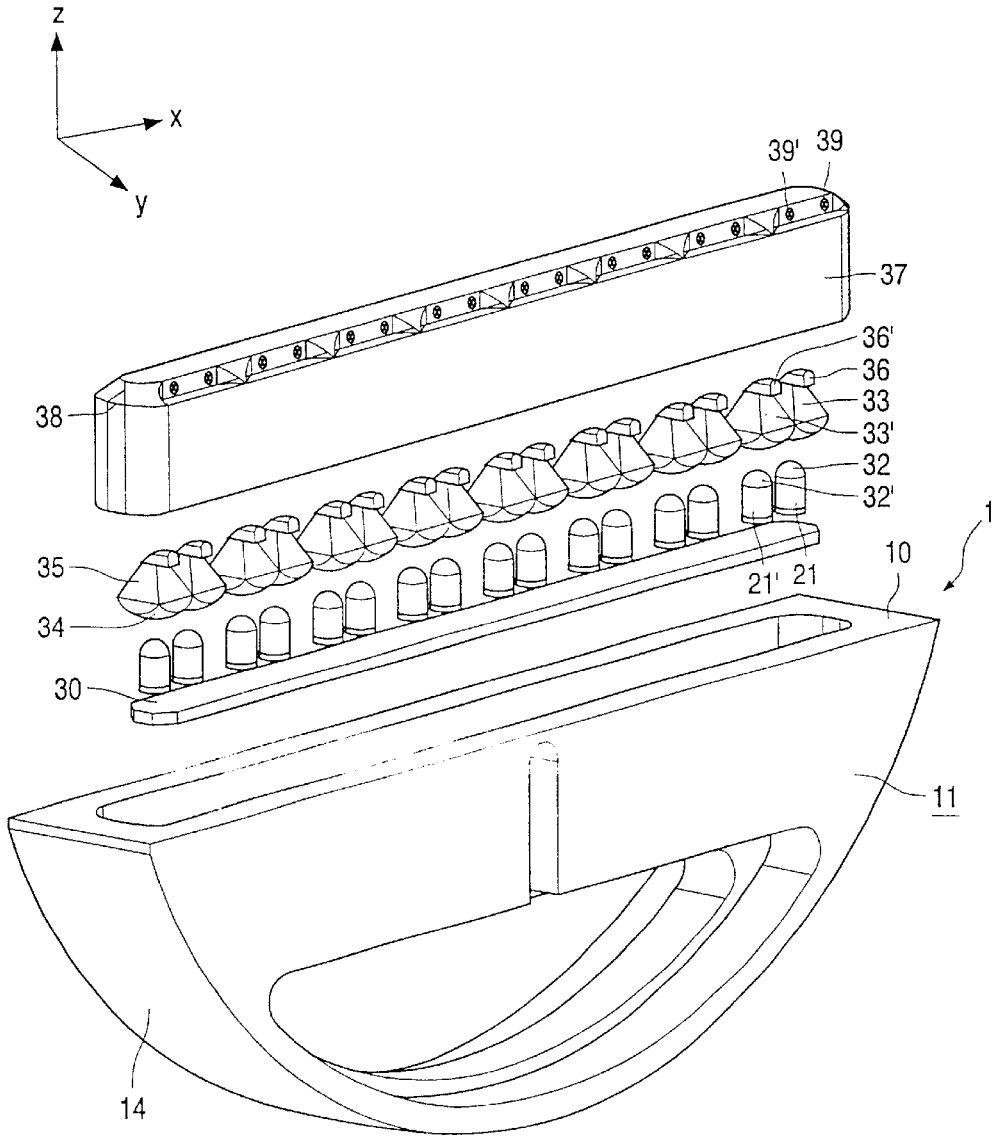
FIG. 4 is an exploded view of an alternative embodiment of a road-marking unit according to the invention.

FIG. 4 is an exploded view of an embodiment of the unit 1 having a housing 11 with a shape which is a hollow cylindrical circular segment 14 and with an insertion opening in its emission surface 10. The following parts are inserted in the housing 11: a printed circuit board 30, a plurality of Light Emitting Diodes (LEDs) 21, 21'. . . , a plurality of collimators 33, 33' . . . , and an emission surface element 37. Sixteen LEDs 21, 21' . . . are mounted on the printed circuit board 30, the LEDs having light emission windows 32, 32' . . . of about 5 mm in cross-section. During operation of the unit 1 each LED 21 of the plurality of LEDs emits light which is collimated by a respective collimator 33, 33' . . . of the plurality of collimators. The collimator 33 is a Compound Parabolic Concentrator (CPC) having a light inlet surface 34 through which the light from the LED 31 enters the CPC 33. The light from the LED 31 is concentrated and subsequently deflected by a prismatic part 35 of the CPC 33 through an angle of about 80° in order to make it leave the CPC 33 through an aperture 36 having a cross-section of about 1.5 mm, the light enclosing an angle $\alpha$ of about 20° with the road surface. Before their insertion in the housing 11, both the plurality of LEDs 21, 21' . . . and the CPCs 33, 33' . . . are inserted in an emission surface element 37 in such a way that the apertures 36, 36' . . . of the CPCs 33, 33' . . . are positioned in front of openings 39, 39' . . . of the surface element 37. Subsequently, the surface element 37 containing the LEDs 21, 21' . . . and the CPCs 33, 33' . . . is inserted in the housing 11 to such an depth that an edge 38 of the surface element 37 lies flush with the emission surface 10.

What is claimed is:

1. A road-marking system comprising:

at least a first (1) and a second road-marking unit (2) each having an emission surface (10; 20), the first unit (1) comprising a first light source (21, 21' . . . ) and the second unit (2) comprising a second light source (22, 22' . . . ), characterized in that each unit (1; 2) has a shape adapted to a saw-cut recess (9) for accommodating the unit (1; 2)

wherein at least one of the light sources comprise an optoelectronic element comprising a light-emitting diode (21, 21' . . . ), and a collimator (33, 33' . . . ) for collimating light from the light-emitting diode and for directing the light through an opening (39, 39' . . . ) in the emission surface (10).

2. A road-marking system as claimed in claim 1, characterized in that the recess (9) for accommodating the unit (1; 2) has a cylindrical bottom part in the shape of circular segment.

3. A road-marking system as claimed in claim 1 or 2, characterized in that the recess (9) for accommodating the unit (1; 2) is obtainable by a saw-cut or by a saw-cut in combination with a drill-hole.

4. A road-marking system comprising:

at least a first (1) and a second road-marking unit (2) each having an emission surface (10; 20), the first unit (1) comprising a first light source (21, 21' . . . ) and the second unit (2) comprising a second light source (22, 22' . . . ), characterized in that each unit (1; 2) has a shape adapted to a saw-cut recess (9) for accommodating the unit (1; 2)

characterized in that, during normal operation of the system, light beams originating from the first (21, 21' . . . ) and the second light source (22, 22' . . . ) and appearing at the emission surface (10; 20) of the respective unit (1; 2) overlap each other at a distance $\geqq 40$ m from the first light source in a plane which encloses an angle $\alpha$, $0.1° < \alpha \leqq 8°$, with a line L which interconnects the first and the second light source.

5. A road-marking system as claimed in claim 1 or 2, characterized in that the road marking unit (1; 2) comprises at least one stabilizer (23; 24) at least adjacent to the emission surface (10; 20).

6. A road-marking system as claimed in claim 5, characterized in that the stabilizer (23; 24) comprises at least one duct (25) at least substantially parallel to the line L for the passage of electrical/optical cables (26).

7. A road-marking system as claimed in claim 1 or 2, characterized in that a distance d between the first (1) and the second road marking unit (2) lies in a range from 10 to 25 cm.

8. A road-marking system as claimed in claim 7, characterized in that the distance d lies in a range from 15 to 20 cm.

9. A road-marking unit (1) for use in a road-marking system as claimed in claim 1 or 2, comprising an emission surface (10) and a light source (21, 21' . . . ), at which unit light beams issue from its emission surface (10), during normal operation, characterized in that said unit (1) has a shape adapted to a recess (9) for accommodating the unit (1), the recess being obtainable by a saw-cut or by a saw-cut in combination with a drill-hole wherein at least one of the light sources comprise an optoelectronic element comprising a light-emitting diode (21, 21' . . . ), and a collimator (33, 33' . . . ) for collimating light from the light-emitting diode and for directing the light through an opening (39, 39' . . . ) in the emission surface (10).

10. A road surface R provided with a road-marking system as claimed in claim 1 or 2 or 4 or at least two road-marking units (1) as claimed in claim 9.

11. A complex for marking roads comprising one or more road-marking systems as claimed in claim 1 or 2 or 4, a control system for the road-marking systems, and means for coupling the road-marking systems to the control system.

12. A road-marking system as claimed in claim 3, characterized in that, during normal operation of the system, light beams originating from the first (21, 21' . . . ) and the second light source (22, 22' . . . ) and appearing at the emission surface (10; 20) off the respective unit (1; 2) overlap each other at a distance $\geqq 40$ m from the first light source in a plane which encloses an angle $\alpha$, $0.1° \leqq \alpha \leqq 8°$, with a line L which interconnects the first and the second light source.

* * * * *